US008795013B1

(12) United States Patent
Nakayama et al.

(10) Patent No.: US 8,795,013 B1
(45) Date of Patent: Aug. 5, 2014

(54) OUTBOARD MOTOR

(75) Inventors: Koichi Nakayama, Shizuoka (JP); Toshio Suzuki, Shizuoka (JP); Katsumi Ochiai, Shizuoka (JP); Shinya Maekawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 365 days.

(21) Appl. No.: 13/293,152

(22) Filed: Nov. 10, 2011

Related U.S. Application Data

(63) Continuation-in-part of application No. 13/196,972, filed on Aug. 3, 2011, now Pat. No. 8,585,452, which is a continuation-in-part of application No. 13/081,532, filed on Apr. 7, 2011, now Pat. No. 8,469,754.

(51) Int. Cl.
*F01N 13/10* (2010.01)

(52) U.S. Cl.
USPC ..... 440/89 H; 60/323

(58) Field of Classification Search
CPC . F01N 13/004; F01N 2590/021; F01N 13/12; F01N 3/046; F01N 13/102; F01N 13/10; F01N 13/08; F02B 61/045
USPC ..... 440/89 A, 89 H, 89 R; 60/298, 299, 302, 60/309, 317, 321, 323, 324
See application file for complete search history.

(56) References Cited

U.S. PATENT DOCUMENTS

| | | | | |
|---|---|---|---|---|
| 5,378,180 | A * | 1/1995 | Nakayama et al. | 440/89 R |
| 6,478,645 | B1 * | 11/2002 | Allbright et al. | 440/89 R |
| 8,230,680 | B2 * | 7/2012 | Riekers et al. | 60/323 |
| 2010/0240269 | A1 | 9/2010 | Ochiai | |

FOREIGN PATENT DOCUMENTS

| | | | |
|---|---|---|---|
| JP | 2007-211663 | A | 8/2007 |
| JP | 2010-242744 | A | 10/2010 |

OTHER PUBLICATIONS

Maekawa et al., "Outboard Motor", U.S. Appl. No. 13/081,532, filed Apr. 7, 2011.
Maekawa et al., "Marine Propulsion Device", U.S. Appl. No. 13/196,972, filed Aug. 3, 2011.
Katsumi Ochiai et al., "Outboard Motor," U.S. Appl. No. 13/903,146, filed May 28, 2013.
Maekawa et al., "Outboard Motor," U.S. Appl. No. 13/651,604, filed Oct. 15, 2012.

* cited by examiner

*Primary Examiner* — Lars A Olson
(74) *Attorney, Agent, or Firm* — Keating & Bennett, LLP

(57) ABSTRACT

In an outboard motor, an exhaust collecting pipe is disposed so as to extend in a vertical direction. The exhaust collecting pipe collects exhaust emitted from a plurality of exhaust ports. A catalyst housing pipe is disposed along a horizontal direction with the exhaust collecting pipe. The catalyst housing pipe is disposed so as to extend in the vertical direction. A catalyst member is housed in the catalyst housing pipe. A connecting pipe is disposed so as to extend in a horizontal direction. The connecting pipe connects the exhaust collecting pipe and the catalyst housing pipe. A protruding portion is provided at a top or a bottom of an inside surface of the connecting pipe.

13 Claims, 9 Drawing Sheets

OUTBOARD MOTOR

BACKGROUND OF THE INVENTION

1. Field of the Invention

The present invention relates to an outboard motor.

2. Description of the Related Art

Outboard motors provided with catalysts for improving environmental performance have recently been developed. For example, in the outboard motor disclosed in JP-A-2010-242744, a catalyst is disposed to the side of an engine. The engine includes a plurality of cylinders and a plurality of exhaust ports. The cylinders are aligned vertically. The exhaust ports are aligned vertically. The exhaust ports are connected to an exhaust manifold. An exhaust pipe storing the catalyst is connected to the exhaust manifold. Exhaust from the exhaust ports is collected in the exhaust manifold and sent to the catalyst. $NO_x$ and other contaminants included in the exhaust are cleaned by the catalyst.

To improve the catalyst cleaning performance described above, it is important that the flow of exhaust to the catalyst be uniform. In the exhaust catalyst device disclosed in JP-A-2007-211663, the flow of exhaust is made uniform by forming a swelling portion in the exhaust pipe. The swelling portion is formed in the exhaust pipe disposed between the exhaust ports of the engine and the catalyst. The swelling portion is formed in a wall surface of the exhaust pipe where exhaust emitted from the exhaust ports strikes at a substantially perpendicular angle. The swelling portion is configured so as to swell toward the outside of the exhaust pipe.

In an outboard motor, the engine is disposed in a space that is limited to only the interior of a cowling. Accordingly, there is only a very small degree of freedom to arrange the exhaust pipe connected to the engine. Furthermore, the degree of freedom provided to arrange the exhaust pipe is further reduced in cases in which the catalyst is disposed in the exhaust pipe in order to improve environmental performance. Therefore, it is difficult in an outboard motor to form a swelling portion such as the one disclosed in JP-A-2010-242744 in the exhaust pipe because there is insufficient space upstream of the catalyst.

SUMMARY OF THE INVENTION

Preferred embodiments of the present invention provide an outboard motor in which the flow of exhaust to the catalyst is uniform and any increase in the space in which an exhaust pipe is disposed can be minimized and prevented.

An outboard motor according to a preferred embodiment of the present invention includes an engine, an exhaust collecting pipe, a catalyst housing pipe, a catalyst member, a connecting pipe, and a protruding portion. The engine includes a plurality of cylinders and a plurality of exhaust ports. The cylinders are disposed along a vertical direction. A plurality of exhaust ports is connected to each of the cylinders. The exhaust ports are disposed along a vertical direction. The exhaust collecting pipe is disposed so as to extend in a vertical direction. The exhaust collecting pipe collects exhaust emitted from the exhaust ports. The catalyst housing pipe is disposed along a horizontal direction with the exhaust collecting pipe. The catalyst housing pipe is disposed so as to extend in the vertical direction. The catalyst member is housed within the catalyst housing pipe. The connecting pipe is disposed so as to extend in a horizontal direction. The connecting pipe connects the exhaust collecting pipe and the catalyst housing pipe. The protruding portion is provided either at the top or bottom of the inside surface of the connecting pipe.

In the outboard motor according to a preferred embodiment of the present invention, the protruding portion is preferably provided either at the top or bottom of the inside surface of the connecting pipe. Therefore, the flow of exhaust flowing vertically within the exhaust collecting pipe can be made uniform in the connecting pipe. Since the protruding portion is provided at the inside surface of the connecting pipe, it is possible to minimize any increase in the space in which the exhaust pipe is disposed in the outboard motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
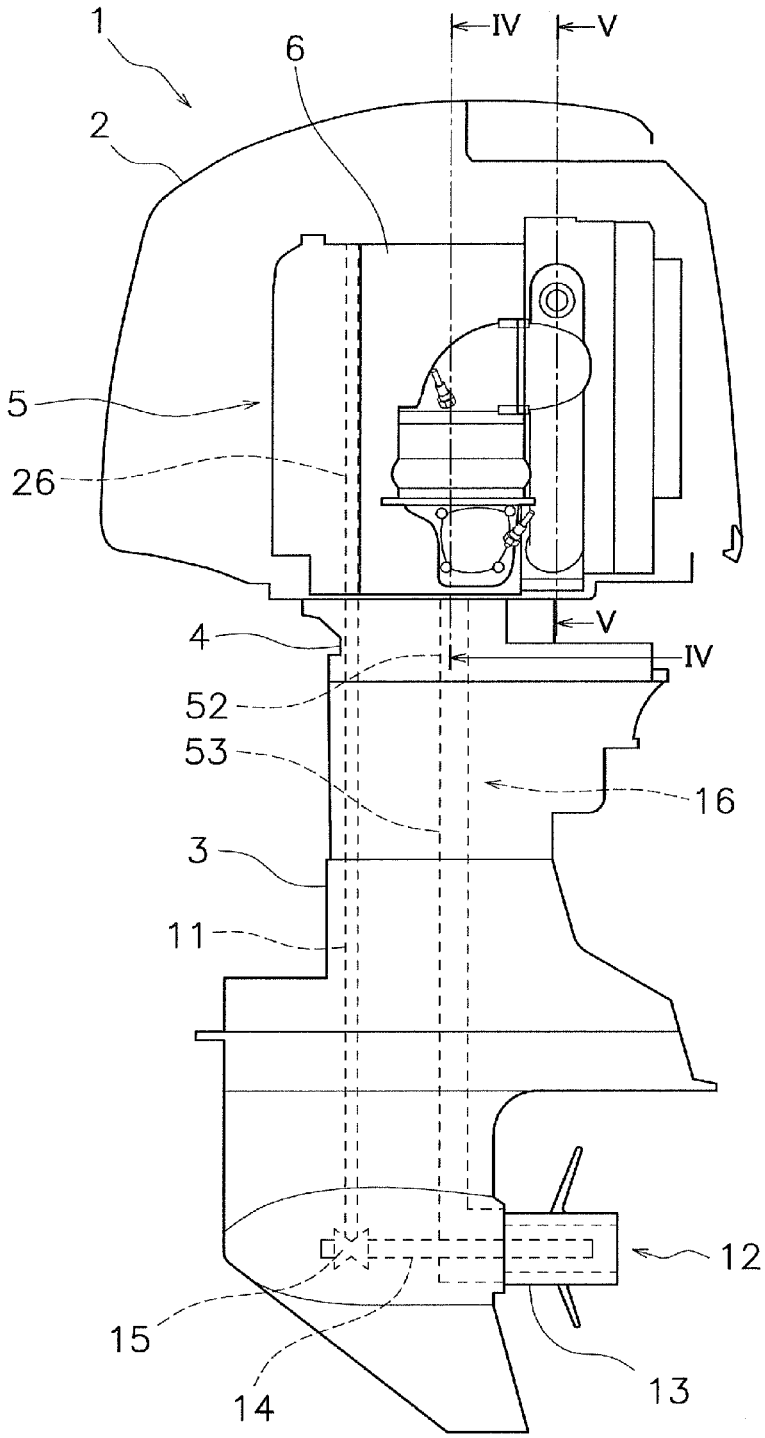
FIG. 1 is a side view of an outboard motor according to a preferred embodiment of the present invention.
Figure 2:
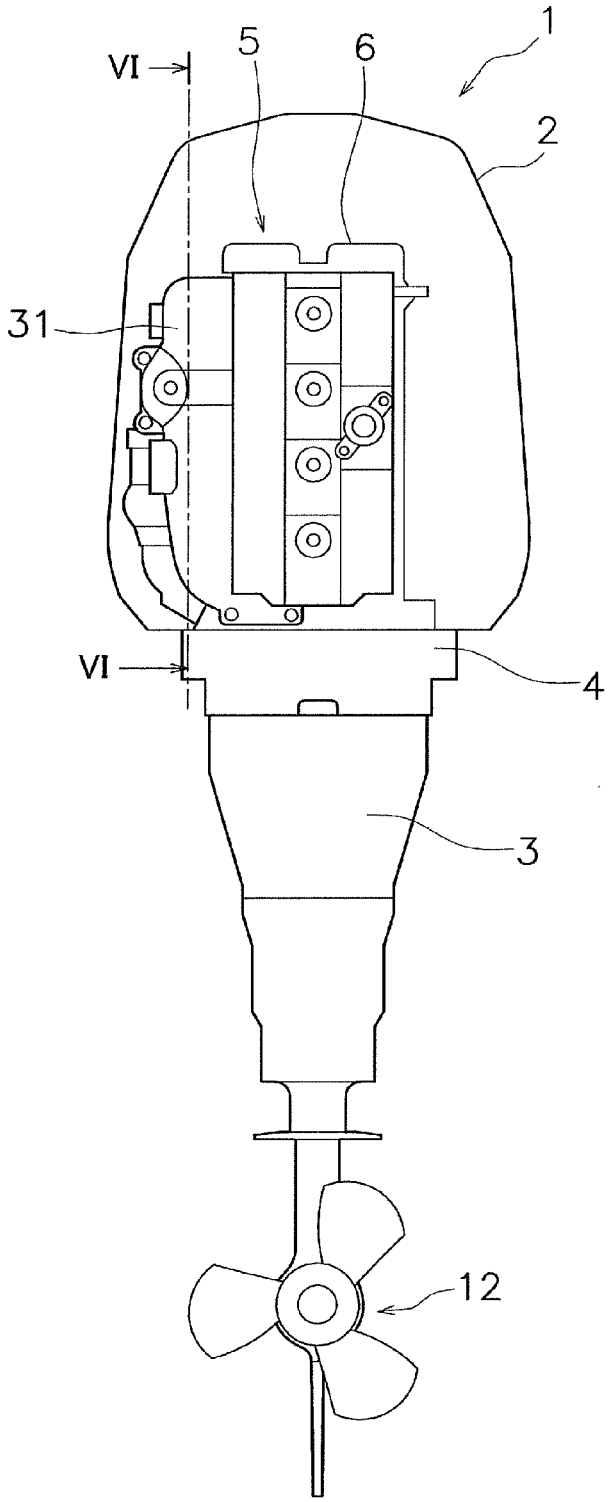
FIG. 2 is a rear view of the outboard motor.

FIG. 1 is a side view showing an outboard motor 1 according to a preferred embodiment of the present invention. FIG. 2 is a rear view showing the outboard motor 1 according to the present preferred embodiment of the present invention shown in FIG. 1. As shown in FIGS. 1 and 2, the outboard motor 1 according to the present preferred embodiment includes an upper casing 2, a lower casing 3, an exhaust guide section 4, and an engine unit 5. For ease of understanding, the upper casing 2 is shown in cross section in FIGS. 1 and 2. The upper casing 2, the lower casing 3, and the engine unit 5 are fixed to the exhaust guide section 4.

The engine unit 5 is disposed inside the upper casing 2. A drive shaft 11 is disposed inside the lower casing 3, as shown in FIG. 1. The drive shaft 11 is disposed in the vertical direction inside the lower casing 3. The drive shaft 11 is fixed to a crankshaft 26 of an engine 6. A propeller 12 is disposed on the bottom portion of the lower casing 3. The propeller 12 is disposed below the engine 6. The propeller 12 includes a propeller boss 13. A propeller shaft 14 is disposed inside the propeller boss 13. The propeller shaft 14 is disposed in a front-back direction. The propeller shaft 14 is linked to the bottom portion of the drive shaft 11 via a bevel gear 15.

In the outboard motor 1, the drive force generated by the engine 6 is transmitted to the propeller 12 via the drive shaft 11 and the propeller shaft 14. The propeller 12 is thereby rotated forward or in reverse. As a result, a propulsion force will be generated to cause the vessel equipped with the outboard motor 1 to move forward or backward.

The outboard motor 1 includes an exhaust passage 16. The exhaust passage 16 is provided so as to extend from the engine 6 through the exhaust guide section 4 and the lower casing 3 to the propeller boss 13 of the propeller 12. The exhaust discharged from the engine 6 is discharged into the water from the exhaust passage 16 through the propeller boss 13.

Figure 3:
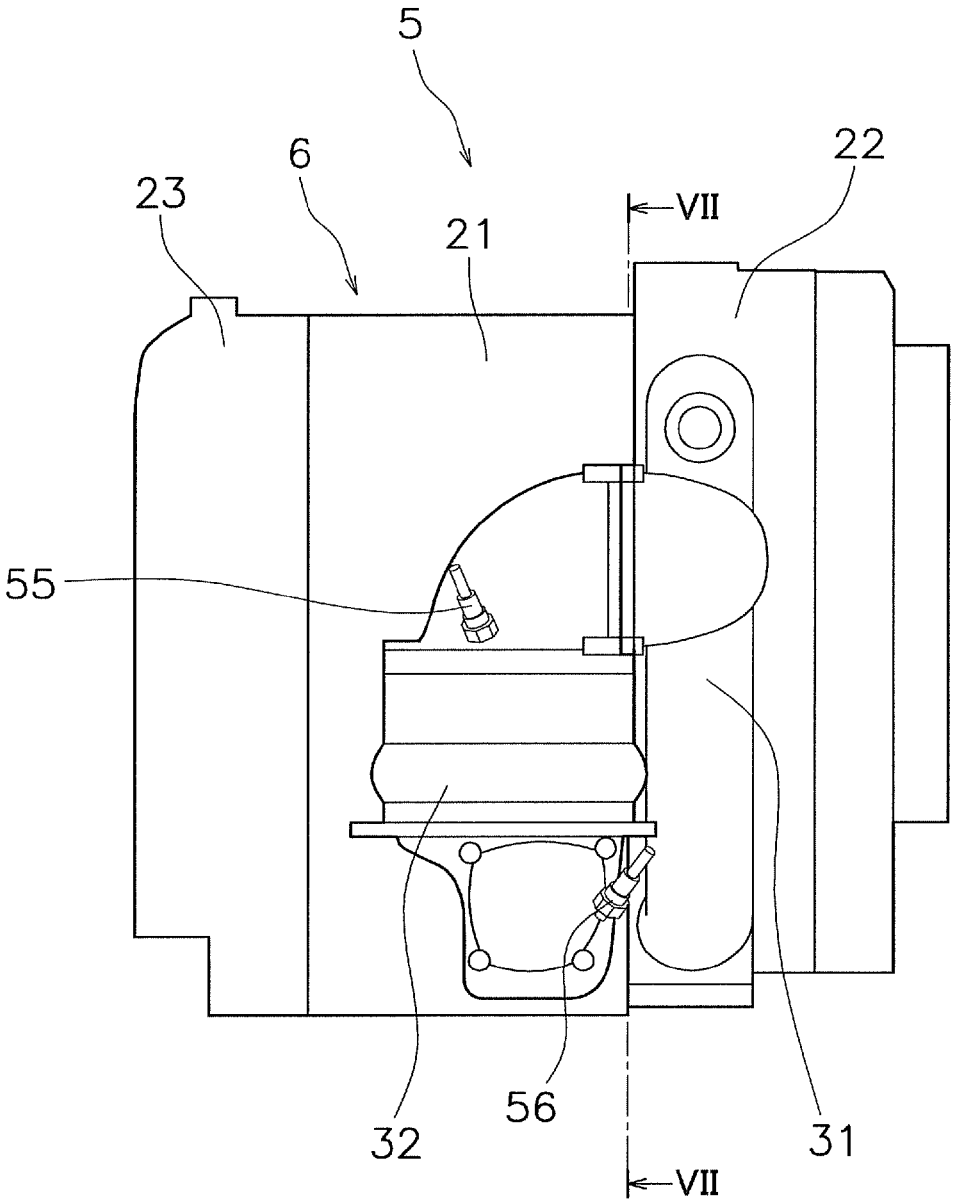
FIG. 3 is a side view of an engine unit.

FIG. 3 is a side view of the engine unit 5. The engine unit 5 includes an engine 6, an exhaust manifold 31, and a catalyst unit 32, as shown in FIG. 3.

Figure 4:
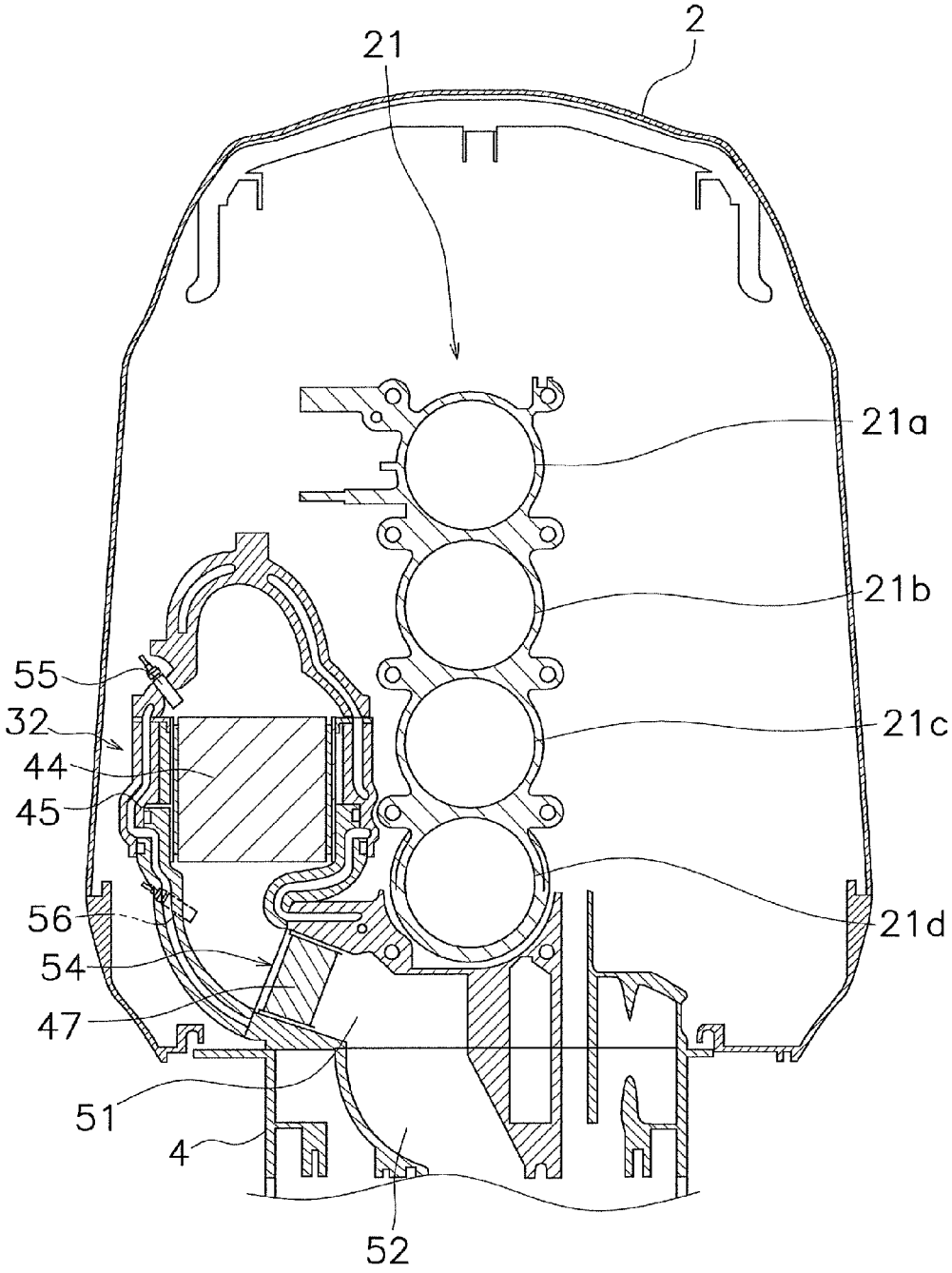
FIG. 4 is a cross-sectional view along line IV-IV in FIG. 1.

The engine 6 includes a cylinder block 21, a cylinder head 22, and a crankcase 23. The cylinder block 21 is disposed above the exhaust guide section 4 and fixed to the exhaust guide section 4. FIG. 4 is a cross-sectional view of IV-IV of the outboard motor 1 in FIG. 1. As shown in FIG. 4, the cylinder block 21 preferably includes four cylinders 21*a* to 21*d*, for example. The four cylinders 21*a* to 21*d* are preferably arranged in a line in a vertical direction.

Figure 5:
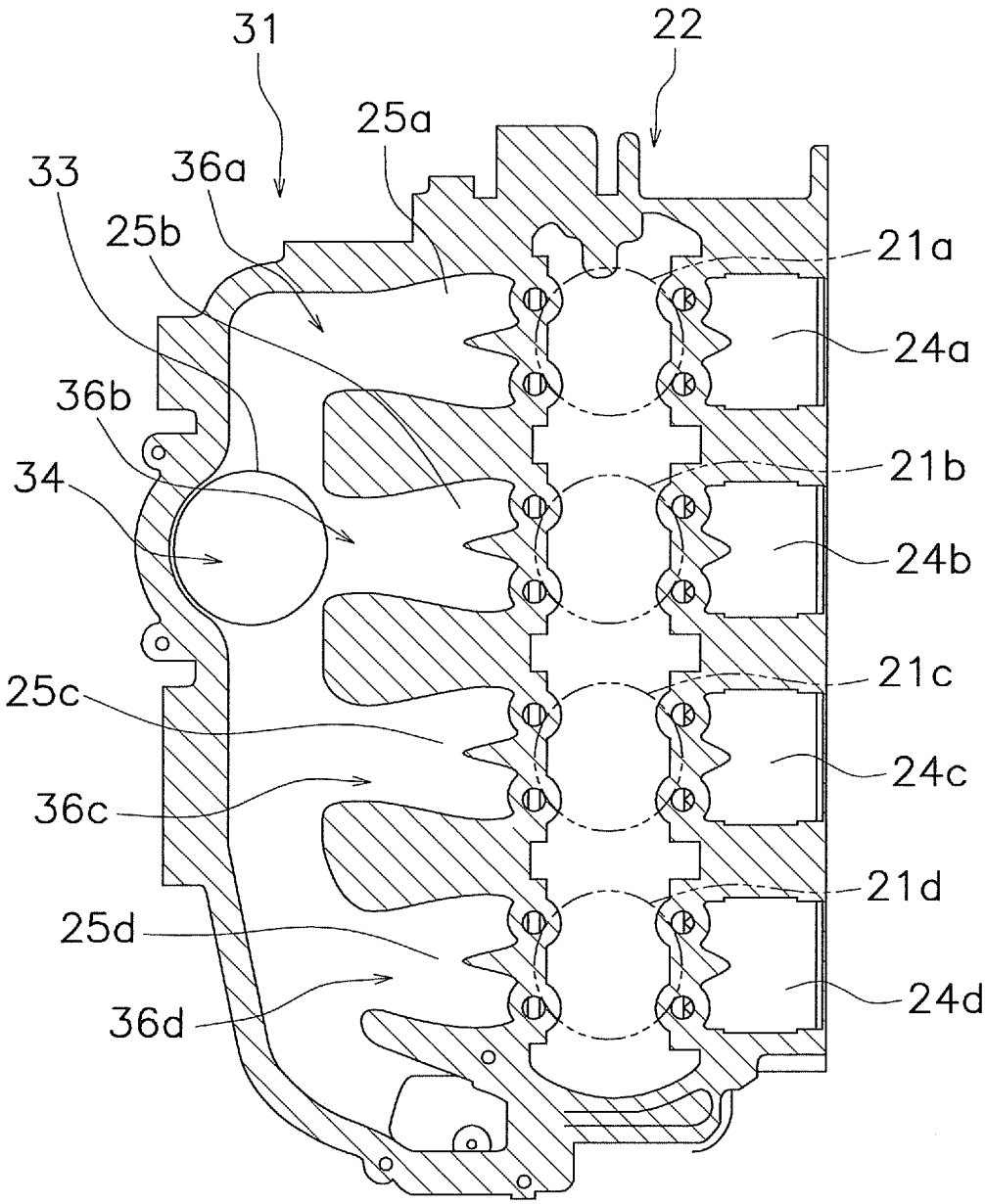
FIG. 5 is a cross-sectional view along line V-V in FIG. 1.

As shown in FIG. 3, the cylinder head 22 is disposed behind the cylinder block 21. FIG. 5 is a cross-sectional view of the outboard motor 1 along line V-V in FIG. 1. As shown in FIG. 5, intake ports 24*a* to 24*d* and exhaust ports 25*a* to 25*d* are provided inside the cylinder head 22. The intake ports 24*a* to 24*d* and the exhaust ports 25*a* to 25*d* are connected to the cylinders 21*a* to 21*d*, respectively. The intake ports 24*a* to 24*d* are preferably arranged in a line in a vertical direction. The intake ports 24*a* to 24*d* are connected to a fuel supply system not shown in the drawing. The exhaust ports 25*a* to 25*d* are disposed in a line in a vertical direction. The exhaust ports 25*a* to 25*d* are extended sideways and connected to the exhaust manifold 31.

The crankcase 23 is disposed at the front of the cylinder block 21, as shown in FIG. 3. The crankshaft 26 (see FIG. 1) is disposed inside the crankcase 23. The crankshaft 26 extends in a vertical direction. The top end portion of the above-described driveshaft 11 is linked to the bottom end portion of the crankshaft 26. The movement of a piston (not shown) disposed inside the cylinders 21*a* to 21*d* is transmitted to the driveshaft 11 via the crankshaft 26.

The exhaust manifold 31 is disposed on the side of the cylinder head 22, as shown in FIG. 3. The exhaust manifold 31 is preferably integral and monolithic with the cylinder head 22. The exhaust manifold 31 is disposed so as to extend in a vertical direction. A plurality of openings 36*a* to 36*d* are provided in the exhaust manifold 31, and the exhaust manifold 31 and the exhaust ports 25*a* to 25*d* are connected via the openings 36*a* to 36*d*, as shown in FIG. 5. The exhaust manifold 31 collects exhaust emitted from the exhaust ports 25*a* to 25*d*. The exhaust manifold 31 includes a first opening 33. The first opening 33 is positioned between the cylinder 21*a* positioned uppermost, and the cylinder 21*d* is positioned lowermost, of the cylinders 21*a* to 21*d*. The first opening 33 is connected to one end of a connecting pipe 34 described hereinafter. The exhaust manifold 31 defines an exhaust collecting pipe according to a preferred embodiment of the present invention.

Figure 6:
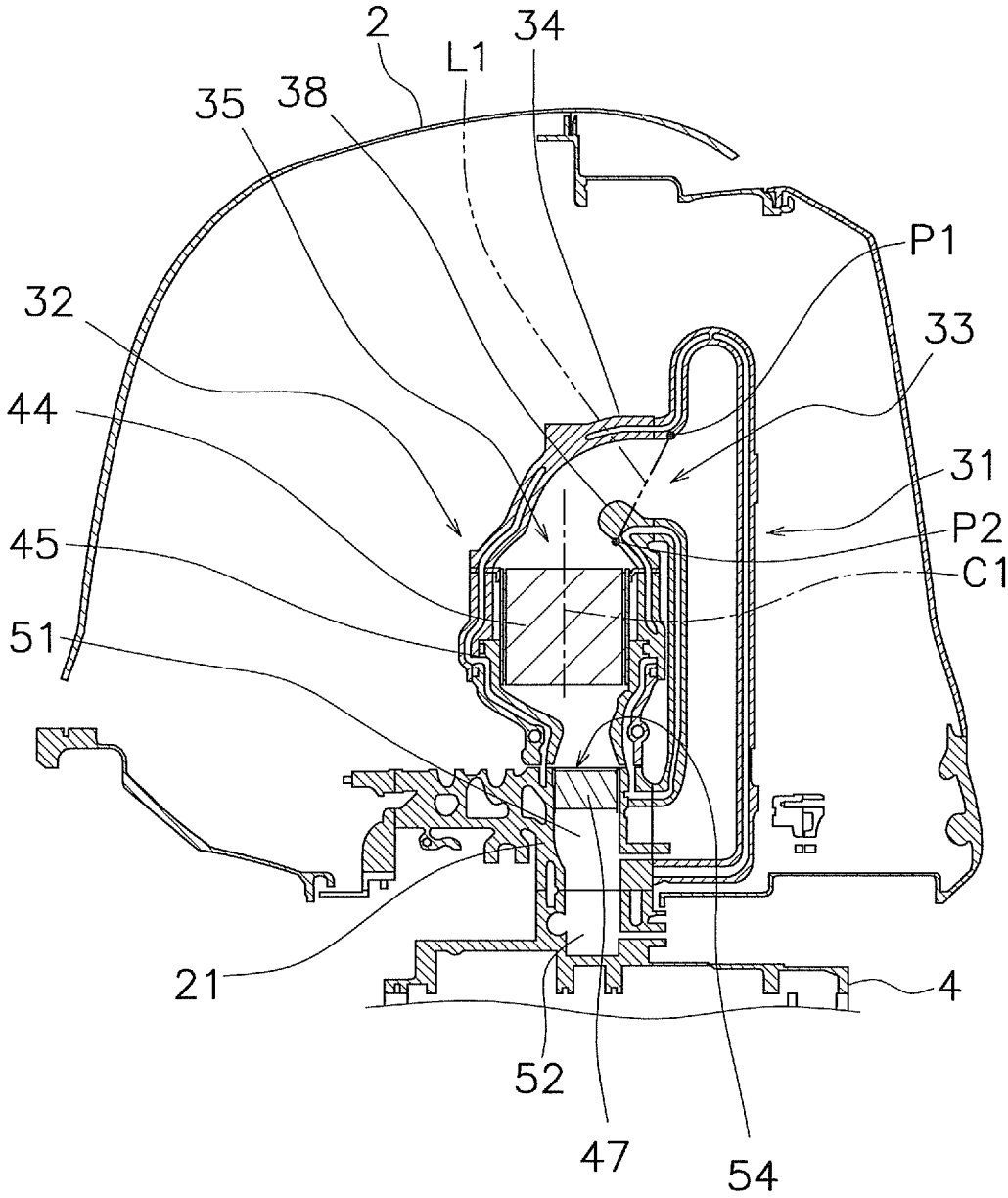
FIG. 6 is a cross-sectional view along line VI-VI in FIG. 2.

The connecting pipe 34 connects the exhaust manifold 31 and the catalyst unit 32 as shown in FIG. 6. The connecting pipe 34 is disposed so as to extend in a horizontal direction. The connecting pipe 34 is connected to the exhaust manifold 31 between the uppermost cylinder 21*a*, and the lowermost cylinder 21*d*, of the plurality of cylinders 21*a* to 21*d*. Specifically, the portion connecting the connecting pipe 34 and the exhaust manifold 31 is positioned between the top end of the cylinder 21*a* positioned at the uppermost of the plurality of cylinders 21*a* to 21*d*, and the bottom end of the cylinder 21*d* positioned at the lowermost of the plurality of cylinders 21*a* to 21*d*. Specifically, the vertical center portion of the portion connecting the connecting pipe 34 and the exhaust manifold 31 is positioned higher than the vertical center portion of the exhaust manifold 31. More specifically, the portion connecting the connecting pipe 34 and the exhaust manifold 31 is positioned at roughly the same height as the second highest cylinder 21*b* of the four cylinders 21*a* to 21*d*. The connecting pipe 34 extends in a front-back direction from the exhaust manifold 31. The connecting pipe 34 is substantially parallel to the central axis line of the cylinders 21*a* to 21*d*. In other words, the connecting pipe 34 extends in a roughly horizontal direction. A protruding portion 38 is provided at the bottom of the inside surface of the connecting pipe 34. The protruding portion 38 is described in detail hereinafter.

The catalyst unit 32 includes a catalyst member 44 and a catalyst housing pipe 45 as shown in FIGS. 4 and 6. The catalyst member 44 is disposed inside the catalyst housing pipe 45. The catalyst member 44 is positioned above the bottom end portion of the cylinder 21*d*, which is the lowest-positioned of the four cylinders 21*a* to 21*d*. The catalyst housing pipe 45 is disposed in a line in a horizontal direction with the exhaust manifold 31. The catalyst housing pipe 45 is disposed so as to extend in a vertical direction. The catalyst housing pipe 45 stores the catalyst member 44. The catalyst housing pipe 45 includes a second opening 35. The second opening 35 is connected to the other end of the connecting pipe 34. The catalyst member 44 is disposed lower than the connecting pipe 34. Exhaust flows from the top to the bottom within the catalyst member 44. Exhaust passing through the exhaust passage 16 is cleaned by passing through the catalyst member 44 inside the catalyst housing pipe 45. The catalyst member 44 supports the exhaust-cleaning catalyst. A three-way catalyst, for example, can be used. The catalyst member 44 preferably includes a cylindrical member having a honeycomb structure, for example.

The above-described protruding portion 38 protrudes upward from the inside surface of the connecting pipe 34 as shown in FIG. 6. The protruding portion 38 protrudes from the inside surface of the connecting pipe 34 toward a central axis line C1 of the catalyst member 44. The distal end of the protruding portion 38 is positioned above the catalyst member 44. The protruding portion 38 is positioned on a line L1 connecting the top end P1 of the first opening 33 and the exhaust manifold 31-facing end P2 of the second opening 35. The thickness of the connecting pipe 34 in the section provided with the protruding portion 38 is greater than the thickness of the rest of the connecting pipe 34 not provided with the protruding portion 38.

The catalyst unit 32 also includes a first oxygen sensor 55 and a second oxygen sensor 56 arranged to detect an oxygen concentration in the exhaust, as shown in FIGS. 3 and 4. The first oxygen sensor 55 is disposed in the exhaust passage 16 upstream from the catalyst member 44. Specifically, the first oxygen sensor 55 is disposed above the catalyst member 44 in the catalyst housing pipe 45. The second oxygen sensor 56 is disposed below the catalyst member 44 in the catalyst housing pipe 45. The second oxygen sensor 56 is disposed in the exhaust passage 16 downstream from the catalyst member 44. Specifically, the second oxygen sensor 56 is disposed between the catalyst member 44 and the water capture member 47 in the exhaust passage 16. A detection signal from the first oxygen sensor 55 and the second oxygen sensor 56 is supplied to an ECU (not shown). The ECU controls the engine 6 on the basis of the detection value from the first oxygen sensor 55 and the second oxygen sensor 56.

The exhaust manifold 31, the connecting pipe 34, and the catalyst unit 32 constitute a portion of the above-described exhaust passage 16. The exhaust passage 16 further includes a first lower passage 51, a second lower passage 52, and a third lower passage 53. The first lower passage 51 is formed inside the cylinder block 21. The first lower passage 51 includes a first lower opening 54. The first lower opening 54 is provided on the lower portion of the lateral surface of the cylinder block 21. The first lower passage 51 is connected to the catalyst unit 32 via the first lower opening 54. The water capture member 47 is disposed downstream of the catalyst member 44. Specifically, the water capture member 47 is disposed in the catalyst unit 32, and is positioned below the catalyst member 44. The water capture member 47 includes a cylindrical member having the similar honeycomb structure as the catalyst member 44 of the catalyst unit 32. The water capture member 47 may be made from a metal honeycomb or ceramic honeycomb. Also, the water capture member 47 may or may not support a catalyst. The water capture member 47 has a smaller outside diameter than does the catalyst member 44 of the catalyst unit 32. The second lower passage 52 is located inside the exhaust guide section 4. The second lower passage 52 is connected to the first lower passage 51, as shown in FIGS. 4 and 6. The third lower passage 53 is located inside the lower casing 3, as shown in FIG. 1. The third lower passage 53 is connected to the second lower passage 52. The third lower passage 53 is also connected to the propeller boss 13.

In the outboard motor 1 according to the present preferred embodiment, the exhaust from the exhaust ports 25*a* to 25*d* of the engine 6 is collected in the exhaust manifold 31. The exhaust flows from the exhaust manifold 31 through the connecting pipe 34 to the catalyst unit 32. The exhaust is cleaned by being passed through the catalyst member 44 in the catalyst unit 32. The exhaust passes from the catalyst unit 32 through the inside sections of the first lower passage 51, the second lower passage 52, the third lower passage 53, and the propeller boss 13, and is discharged outside.

In the outboard motor 1 according to the present preferred embodiment, the connecting pipe 34 is connected to the exhaust manifold 31 between the cylinder 21*a* positioned at the uppermost of the plurality of cylinders 21*a* to 21*d* and the cylinder 21*d* positioned at the lowermost of the cylinders. Therefore, the exhaust from the cylinder 21*a* positioned above the connecting pipe 34 readily flows from the top toward the bottom of the connecting pipe 34. In view of this, in the outboard motor 1 according to the present preferred embodiment, the protruding portion 38 is arranged to protrude upward from the bottom of the inside surface of the connecting pipe 34. Therefore, the downward flow of exhaust is guided upward in the connecting pipe 34. The flow of exhaust can thereby be made uniform in the connecting pipe 34.

The protruding portion 38 is provided at the inside surface of the connecting pipe 34. Specifically, the protruding portion 38 protrudes toward the inside of the connecting pipe 34. Therefore, it is possible to minimize any increase in the space in which an exhaust pipe is disposed in the outboard motor 1 relative to cases in which the connecting pipe 34 has a shape which swells outward.

Since the protruding portion 38 guides the exhaust, the protruding portion 38 is brought to a high temperature by the heat of the exhaust. In view of this, in the outboard motor according to the present preferred embodiment, the thickness of the connecting pipe 34 in the section provided with the protruding portion 38 is preferably greater than the thickness of the rest of the connecting pipe 34 not provided with the protruding portion 38. Therefore, a large heat capacity of the protruding portion 38 can be ensured.

A preferred embodiment of the present invention was described above, but the present invention is not limited to the above-described preferred embodiment and can be modified in a variety of ways within a range that does not depart from the scope of the present invention.

Figure 7:
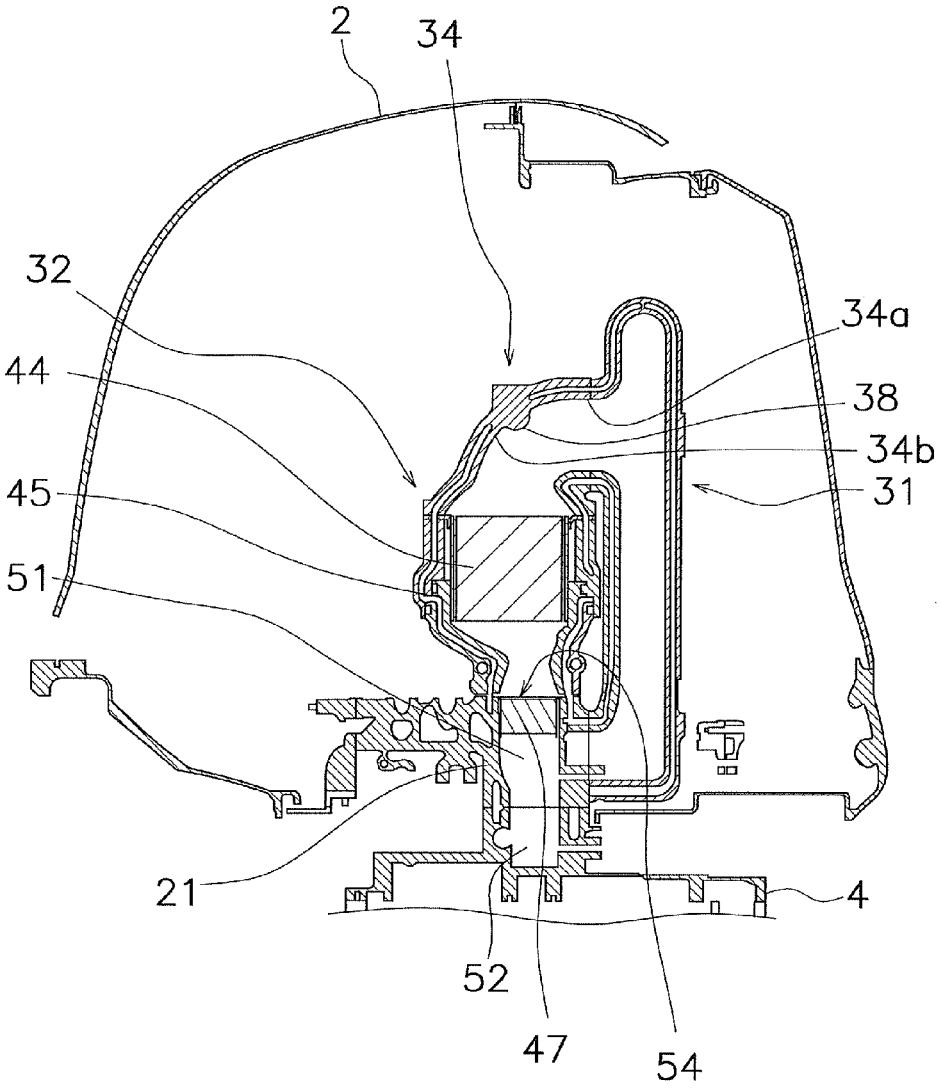
FIG. 7 is a cross-sectional view of an outboard motor according to another preferred embodiment of the present invention.

For example, as shown in FIG. 7, the protruding portion 38 may be provided at the top of the inside surface of the connecting pipe 34. The protruding portion 38 protrudes downward from the top of the inside surface of the connecting pipe 34. Specifically, the top of the inside surface of the connecting pipe 34 includes a straight portion 34*a* and a curved portion 34*b*. The straight portion 34*a* extends roughly horizontally from the exhaust manifold 31. The connecting pipe 34 curves downward toward the catalyst unit 32. The protruding portion 38 is provided in the curved portion 34*b*. The bottom end of the protruding portion 38 is positioned below the straight portion 34*a*. In this case, the exhaust flowing upward from the cylinders 21*c*, 21*d* positioned below the connecting pipe 34 is guided downward by the protruding portion 38 in the connecting pipe 34. The flow of exhaust can thereby be made uniform in the connecting pipe 34.

Figure 8:
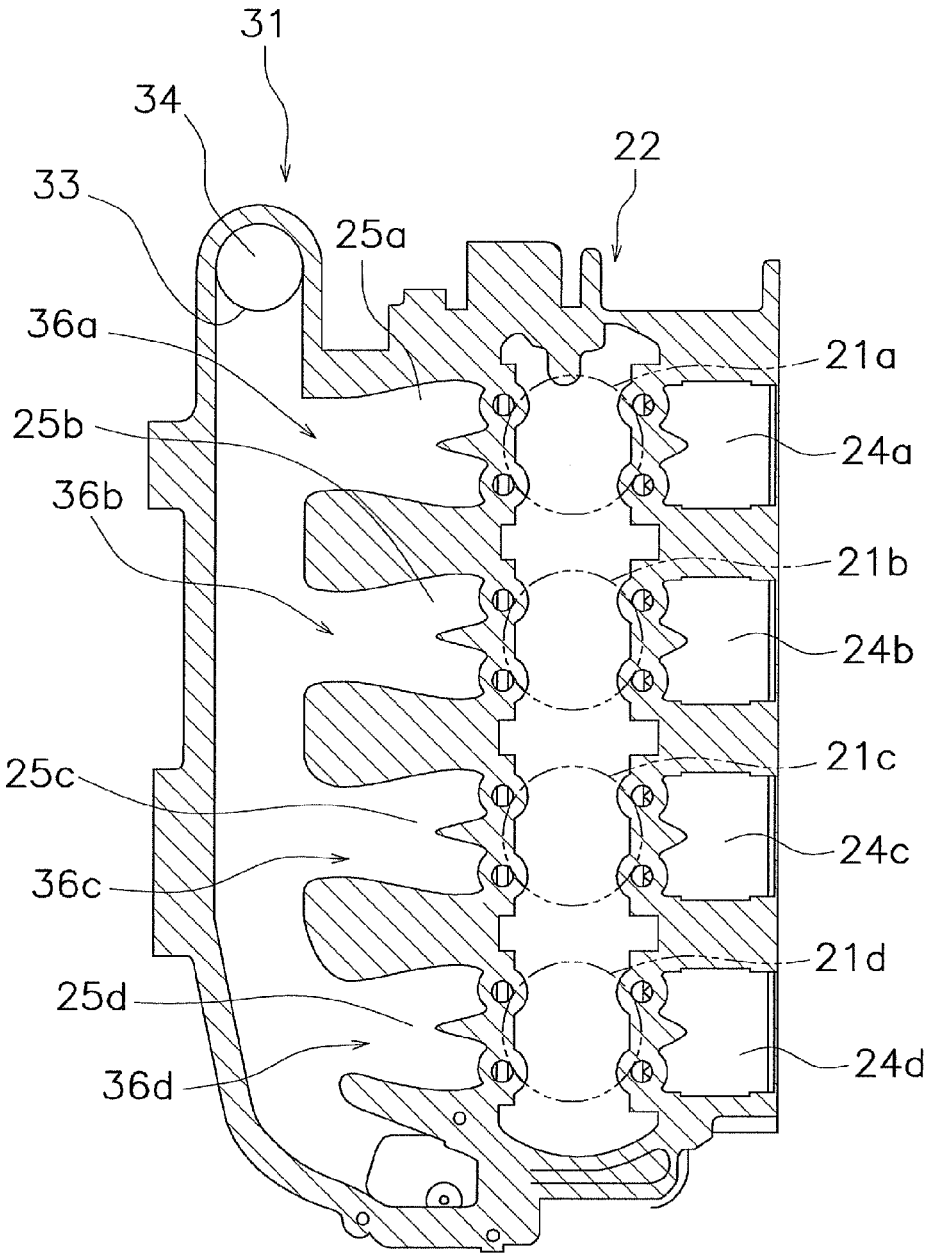
FIG. 8 is a cross-sectional view of an engine unit of an outboard motor according to another preferred embodiment of the present invention.
Figure 9:
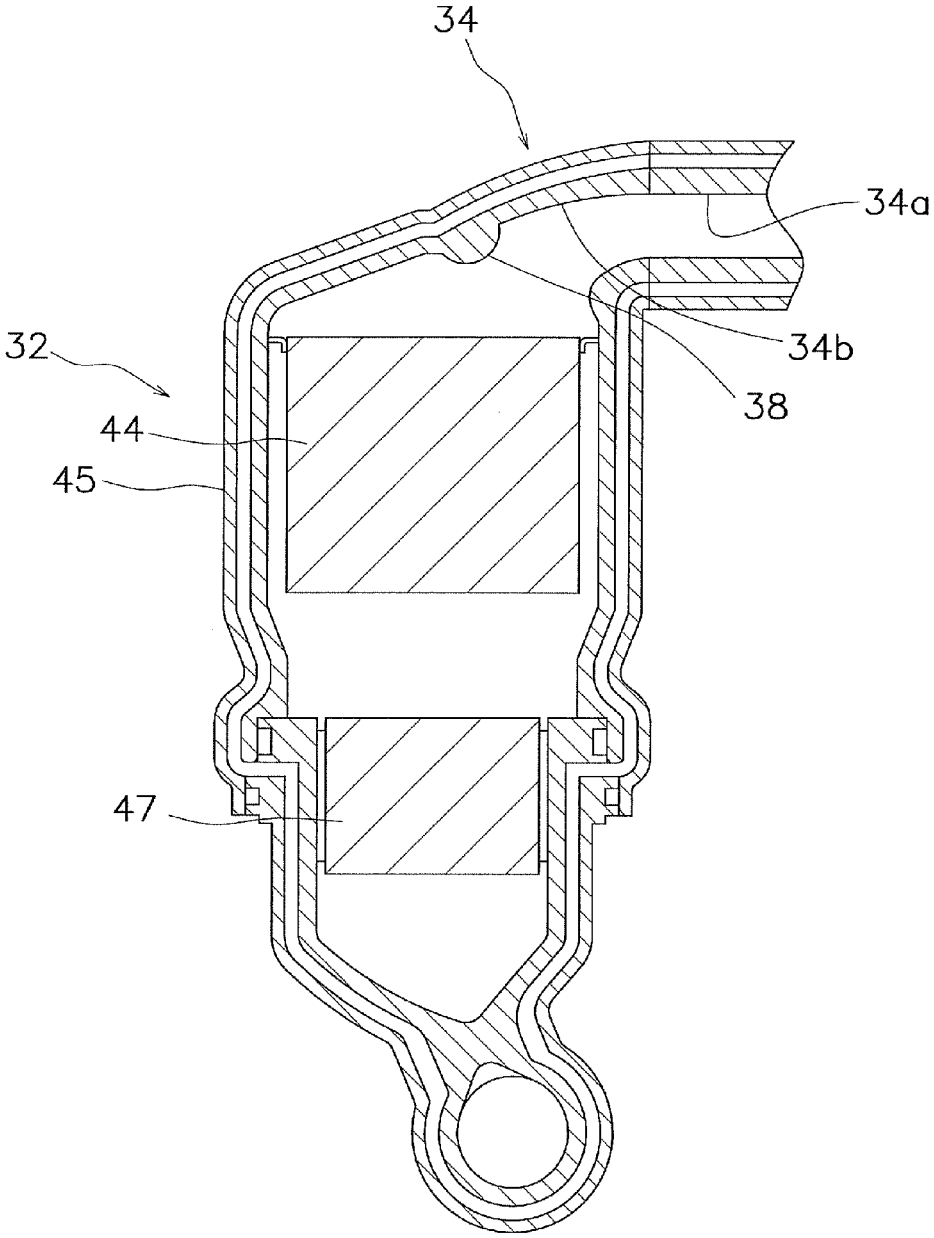
FIG. 9 is a cross-sectional view of a catalyst unit of an outboard motor according to another preferred embodiment of the present invention.

The connecting pipe 34 may be connected to the exhaust manifold 31 above the cylinder 21*a* positioned at the uppermost of the plurality of cylinders 21*a* to 21*d*, as shown in FIG. 8. In this case, the exhaust flowing from the exhaust manifold 31 to the connecting pipe 34 readily flows upward. Therefore, the protruding portion 38 is preferably provided to the top of the inside surface of the connecting pipe 34, as shown in FIG. 9. The protruding portion 38 protrudes downward from the inside surface of the connecting pipe 34. Specifically, the protruding portion 38 is provided in the curved portion 34*b*. The bottom end of the protruding portion 38 is positioned below the straight portion 34*a*. In this case, the exhaust flowing upward from the cylinders 21*a* to 21*d* is guided downward by the protruding portion 38 in the connecting pipe 34. The flow of exhaust can thereby be made uniform in the connecting pipe 34. In FIG. 9, the water capture member 47 is disposed in the catalyst unit 32.

The number of the cylinders is not limited to four. The number of the cylinders may also be three or less. Alternatively, the number of the cylinders may be five or greater.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a plurality of cylinders disposed along a vertical direction, and a plurality of exhaust ports connected respectively to the plurality of cylinders and disposed along the vertical direction;

an exhaust collecting pipe disposed so as to extend in the vertical direction and configured to collect exhaust emitted from the plurality of exhaust ports;

a catalyst housing pipe disposed in a horizontal direction from the exhaust collecting pipe and disposed so as to extend in the vertical direction;

a catalyst member housed within the catalyst housing pipe;

a connecting pipe disposed so as to extend in the horizontal direction and configured to connect the exhaust collecting pipe and the catalyst housing pipe; and a protruding portion provided at a top or a bottom of an inside surface of the connecting pipe.

2. The outboard motor according to claim 1, wherein the connecting pipe is connected to the exhaust collecting pipe between an uppermost one and a lowermost one of the plurality of cylinders.

3. The outboard motor according to claim 2, wherein the protruding portion is provided at the bottom of the inside surface of the connecting pipe.

4. The outboard motor according to claim 3, wherein the protruding portion protrudes upward from the inside surface of the connecting pipe.

5. The outboard motor according to claim 3, wherein the catalyst member is disposed below the connecting pipe, and exhaust flows from a top toward a bottom in the catalyst member.

6. The outboard motor according to claim 2, wherein the protruding portion is provided at the top of the inside surface of the connecting pipe.

7. The outboard motor according to claim 6, wherein the protruding portion protrudes downward from the inside surface of the connecting pipe.

8. The outboard motor according to claim 1, wherein the exhaust collecting pipe includes an opening positioned between a uppermost one and a lowermost one of the plurality of cylinders, the first opening connected to a first end of the connecting pipe;

the catalyst housing pipe includes an opening connected to a second end of the connecting pipe; and the protruding portion is positioned on a line connecting a top end of the opening in the exhaust collecting pipe and an end of the opening in the catalyst housing pipe facing the exhaust collecting pipe.

9. The outboard motor according to claim 1, wherein the connecting pipe is connected to the exhaust collecting pipe above an uppermost one of the plurality of cylinders.

10. The outboard motor according to claim 9, wherein the protruding portion is provided at the top of the inside surface of the connecting pipe.

11. The outboard motor according to claim 10, wherein the protruding portion protrudes downward from the inside surface of the connecting pipe.

12. The outboard motor according to claim 10, wherein the catalyst member is disposed below the connecting pipe, and exhaust flows from a top toward a bottom in the catalyst member.

13. The outboard motor according to claim 1, wherein a thickness of the connecting pipe in a section where the protruding portion is provided is greater than a thickness of the connecting pipe in a section where the protruding portion is not provided.

* * * * *